US009373453B2

(12) United States Patent
Scribner

(10) Patent No.: US 9,373,453 B2
(45) Date of Patent: Jun. 21, 2016

(54) MASTER DISCONNECT SWITCH WITH CONTACT WELD BREAKER

(71) Applicant: Dana P. Scribner, Tyngsboro, MA (US)

(72) Inventor: Dana P. Scribner, Tyngsboro, MA (US)

(73) Assignee: LITTELFUSE, INC., Chicago, IL (US)

( * ) Notice: Subject to any disclaimer, the term of this patent is extended or adjusted under 35 U.S.C. 154(b) by 224 days.

(21) Appl. No.: 14/096,391

(22) Filed: Dec. 4, 2013

(65) Prior Publication Data

US 2015/0155117 A1 Jun. 4, 2015

(51) Int. Cl.

| | |
|---|---|
| ***H01H 19/00*** | (2006.01) |
| ***H01H 19/11*** | (2006.01) |
| ***H01H 19/58*** | (2006.01) |
| ***H01H 3/00*** | (2006.01) |
| ***H01H 19/635*** | (2006.01) |

(52) U.S. Cl.

CPC ..... *H01H 3/001* (2013.01); *H01H 19/6355* (2013.01)

(58) Field of Classification Search

CPC .. H01H 19/02; H01H 3/001; H01H 2221/044
USPC ..... 200/11 R, 336, 564, 565, 572
See application file for complete search history.

(56) References Cited

U.S. PATENT DOCUMENTS

| | | | | |
|---|---|---|---|---|
| 3,329,790 | A | 7/1967 | Schink | |
| 3,739,109 | A * | 6/1973 | Ege ..... | H01H 3/001 200/11 EA |
| 4,390,761 | A | 6/1983 | Introvigne | |
| 4,823,231 | A | 4/1989 | Jego et al. | |
| 5,756,947 | A | 5/1998 | Trimble, Jr. et al. | |

OTHER PUBLICATIONS

International Search Report and Written Opinion from corresponding PCT/US2014/065660, mailed Feb. 26, 2015.

* cited by examiner

*Primary Examiner* — Renee Luebke
*Assistant Examiner* — Lheiren Mae A Caroc

(57) ABSTRACT

A switch is described. The switch may have first and second terminals to connect a source of power to a load, a shaft rotatable about a central axis and moveable longitudinally along the central axis, the shaft having a wing extending out orthogonally from the central axis, a contact plate to physically and electrically connect the first and second terminals when the shaft is moved longitudinally along the central axis, and a disengagement ramp to contact the wing when the shaft is rotated about the central axis, the disengagement ramp to force the shaft to move longitudinally along the central axis as the shaft is rotated to move the contact plate away from the first and second terminals.

11 Claims, 12 Drawing Sheets

MASTER DISCONNECT SWITCH WITH CONTACT WELD BREAKER

BACKGROUND OF THE INVENTION

1. Field of the Invention

Embodiments of the present disclosure relate generally to switches and more particularly to master disconnect switches that may be used in vehicles.

2. Discussion of Related Art

Switches may be used to disconnect a power supply from a load. For example, vehicles may include a switch (sometimes referred to as a master disconnect switch) that electrically disconnects the battery from the circuits in the vehicle. This may be used to ensure that power is not supplied to the vehicle prior to performing maintenance. During operation, the switch may be placed in the ON position to electrically connect the power source (e.g., battery) to the load (e.g., vehicle circuits). When the switch is placed in the ON position, the contacts in the switch are closed. Accordingly, current may flow from the power source to the load through the contacts. When a user wishes to electrically disconnect the vehicle from the battery, the user may place the switch in the OFF position, which opens the contacts and breaks the circuit.

During operation of the vehicle, however, as current flows from the power source to the load through the contacts in the switch, the contacts may be heated up due to the amount of current flowing from the power source. Heating of the contacts may cause them to fuse together. This is often referred to as a contact weld. Accordingly, when the switch is activated to open the contacts, they may not open due to the contact weld. As such, the battery will still be electrically connected to the vehicle. Some conventional switches do not provide a way for the contact weld to be broken, thus preventing the contacts from opening. Furthermore, some conventional switches do not provide feedback to let an operator know whether the contacts are actually open or closed. As such, an operator may believe that the battery is electrically disconnected when in actuality it is not.

Thus, there is a need for a switch that can break contact welds and provide positive feedback to an operator that the switch contacts are open.

SUMMARY OF THE INVENTION

Exemplary embodiments of the present disclosure are directed to a switch, usable as a master disconnect switch in a vehicle, which facilitates breaking contact welds to open the switch and also provides positive feedback as to whether the contacts are open or closed.

Some exemplary embodiments of the present disclosure are directed to a switch. The switch may have first and second terminals to connect a source of power to a load, a shaft rotatable about a central axis and moveable longitudinally along the central axis, the shaft having a wing extending out orthogonally from the central axis, a contact plate to physically and electrically connect the first and second terminals when the shaft is moved longitudinally along the central axis, and a disengagement ramp to contact the wing when the shaft is rotated about the central axis, the disengagement ramp to force the shaft to move longitudinally along the central axis as the shaft is rotated to move the contact plate away from the first and second terminals.

Another embodiment describes a switch. The switch including a first stud for connecting to a source of power, a second stud for connecting to a load, a shaft rotatable about a central axis and moveable along the length of the central axis, the shaft having a first wing and a second wing, the first and second wing extending out orthogonally from the central axis, a contact plate disposed on the shaft, the contact plate to electrically connect the first and second studs when the shaft is moved longitudinally along the central axis to electrically connect a source of power to a load, and a first disengagement ramp and a second disengagement ramp to contact the first and second wings when the shaft is rotated about the central axis to force the shaft to move longitudinally and move the contact plate away from the first and second studs to electrically disconnect the first and second studs.

DESCRIPTION OF EMBODIMENTS

Figure 1B:
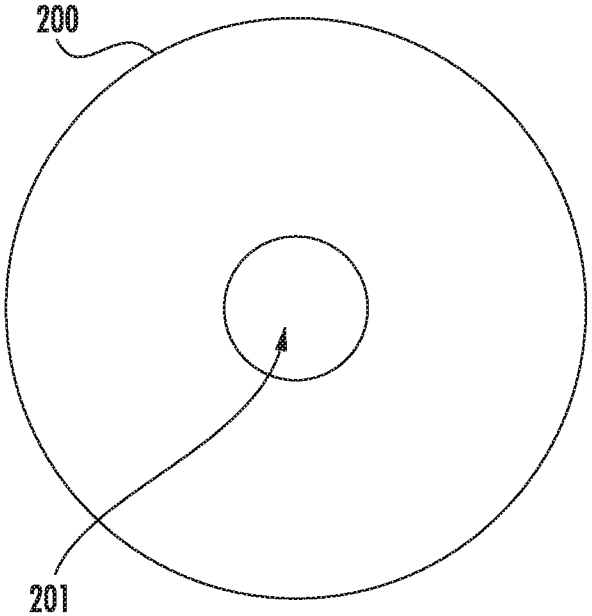
FIGS. 1A-1G are block diagrams illustrating a switch.

Various example embodiments will now be described more fully hereinafter with reference to the accompanying drawings, in which preferred embodiments of the invention are shown. These examples, however, may be embodied in many different forms and should not be construed as limited to the examples set forth herein. Rather, these examples are provided so that this disclosure will be thorough and complete, and will fully convey the scope of the present disclosure to those skilled in the art. In the drawings, like numbers refer to like elements throughout.

FIGS. 1A-1G illustrate block diagrams of a master disconnect switch 1000. In general, FIGS. 1A-1D describe the various component parts of the switch 1000 while FIGS. 1E-1G describe the operation of the switch 1000. The following brief description, however, is provided to give context to the more detailed description of each individual figure. The master disconnect switch 1000 includes a terminal housing 100 and a contact housing 200, which are configured to be mated together to form the switch 1000. Although the examples herein show the terminal housing 100 fitting into a cavity in the contact housing 200, this is not intended to be limiting. For example, with some embodiments, the contact housing may fit into a cavity in the terminal housing. Furthermore, the size and shape of the examples depicted herein is done to facilitate understanding and is not intended to be limiting.

The switch 1000 also includes a shaft disposed in the contact housing. The shaft has wings extending out orthogonally from a central axis and is rotatable about the central axis and moveable longitudinally along the central axis. The shaft may be rotated (e.g., about the central axis) to place the switch in the ON position. As the shaft is rotated, the wings contact engagement ramps. Further rotation causes the wings to slide up the engagement ramps, which causes the contacts in the switch to close and electrically connect the switch terminals. Similarly, the shaft may be rotated (e.g., about the central axis) to place the switch in the OFF position. When the shaft is rotated, the wings travel down the engagement ramps, the contacts open and electrically disconnect the switch terminals. Additionally, the shaft will return to a position designated or known as the OFF position to provide an indicator to an operator that the switch is indeed off. In cases where the switch contacts are stuck to the terminals (e.g., by contact welds, or the like), the wings will contact disengagement ramps. Further rotation of the shaft will cause the wings to slide down the disengagement ramps and force the contacts away from the terminals, thus breaking the contact weld and allowing the terminals to be electrically disconnected. In cases where the contact welds cannot be broken, the shaft will not rotate further due to the disengagement ramps, thus providing feedback to an operator that the switch is not OFF.

Figure 1A:
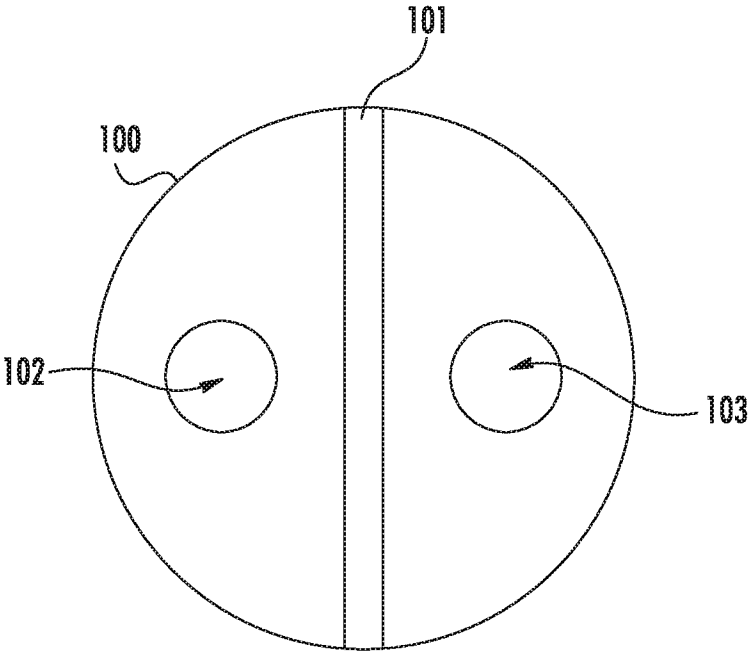
Figure 1C:
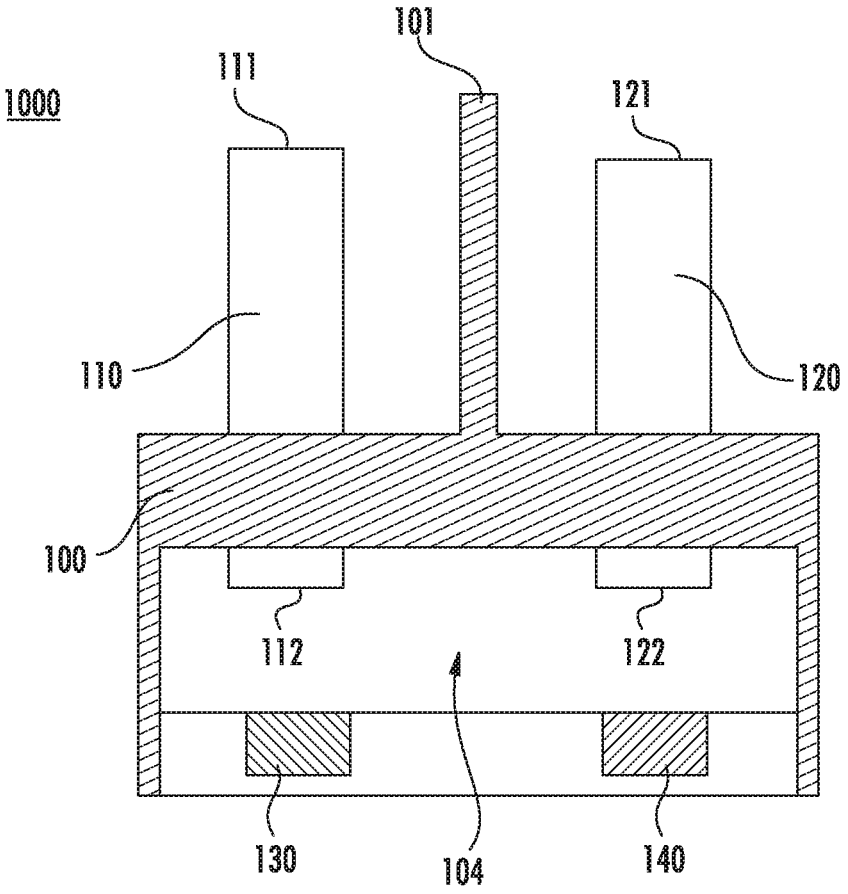

Turning more particularly to FIG. 1A, a top view of the terminal housing 100 is shown. In general, the terminal housing may be made from any nonconductive material, such as, for example, ceramic, plastic, or the like. The terminal housing 100 may include a first through-hole 102 and a second through-hole 103. A partition 101 is disposed between the first and second through-holes 102, 103. Although the terminal housing 100 is shown having a generally circular shape, various embodiments may have other shapes (e.g., square, rectangular, or the like). FIG. 1C shows a cut-away side view of the terminal housing 100. As can be seen, the terminal housing 100 includes a cavity 104. First and second studs 110 and 120 are disposed in the first and second through-holes 102 and 103. In general, the studs 110, 120 may be made from a conductive material, such as, for example, iron, copper, brass, stainless steel, or the like.

Portions of the first and second studs 110, 120 extend out from the terminal housing 100 forming terminal portions 111 and 121. In some examples, the terminal portions may be threaded, for example, to provide for receiving a ring terminal connection and a nut. Furthermore, the terminal portions 111, 121 of the studs 110, 120 are separated by the partition 101. Additionally, portions of the first and second studs 110, 120 extend out from the terminal housing into the cavity 104 forming contact portions 112 and 122. First and second disengagement ramps 130 and 140 are disposed in the cavity 104 of the terminal housing 100. The disengagement ramps 130 and 140 may be positioned that when the terminal housing 100 is mated with the contact housing 200, the disengagement ramps 130, 140 may assist in breaking a contact weld between a contact plate (refer to FIG. 1D) and the contact portions 112, 122 of the studs 110, 120 when the shaft 210 (refer to FIG. 1D) is rotated to turn the switch OFF (refer to FIG. 1G).

Figure 1D:
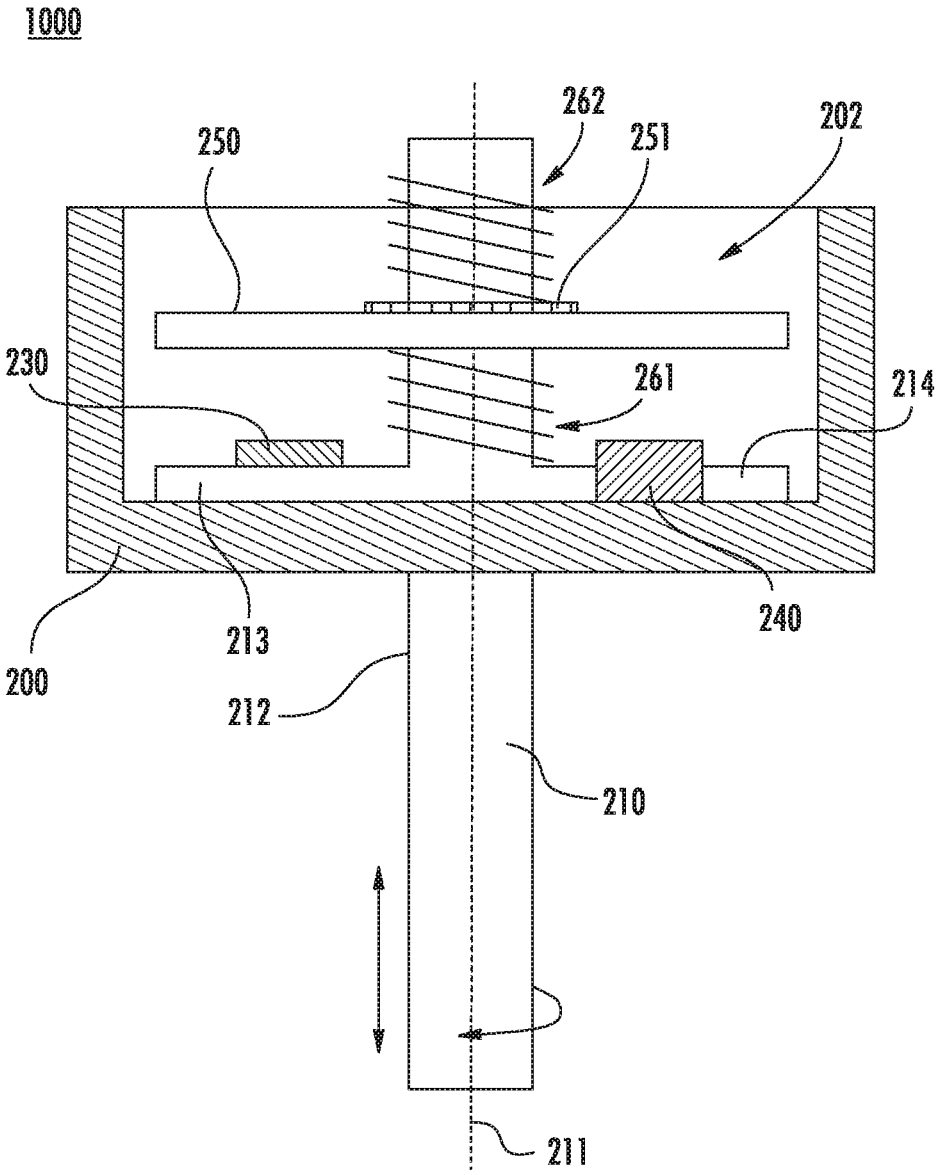

Referring now more particularly to FIG. 1B a top view of the contact housing 200 is shown. In general, the contact housing 200 may be made from a nonconductive material, such as, for example, ceramic, plastic, or the like. As another example, the contact housing 200 may be made from any material, provided that the contact housing 200 does not physically or electrically connect the to the contact plate 250. The contact housing 200 may include a third through-hole 201. Although the contact housing 200 is shown having a generally circular shape, various embodiments may have other shapes (e.g., square, rectangular, or the like). FIG. 1D shows a cut-away side view of the contact housing 200. As can be seen, the contact housing 200 includes a cavity 202. A shaft 210 is disposed in the third through-hole 201. In general, the shaft 210 may be made from a nonconductive material, such as, for example, ceramic, plastic, or the like. As another example, the shaft 210 may be made from any material, provided that shaft 210 does not physically or electrically connect the to the contact plate 250. The shaft 210 is rotatable about a central axis 211. Furthermore, that shaft is moveable about the length of the central axis 211. The shaft has an actuating portion 212 extending out from the contact housing 200. The actuating portion 212 may include a handle (not shown) or other means to facilitate rotating the shaft 210 about the central axis 211. Additionally, the shaft 210 also includes wings 213 and 214 extending out orthogonally from the central axis 211.

A contact plate 250 is disposed on the shaft 210. In general, the contact plate may be made from a conductive material, such as, for example, copper, or the like. Furthermore, the contact plate 250 is fixed in place longitudinally along the central axis 211 of the shaft 210. However, the contact plate may rotate about the central axis 211. Said differently, when the shaft 210 moves along the length of the central axis 211, the contact plate will move a corresponding amount. However, when the shaft 210 rotates about the central axis 211, the contact plate may not rotate or may rotate a different amount. In some examples, the contact plate 250 may be longitudinally fixed in place on the shaft 210 by lock ring 251. In other examples, the contact plate 250 may be longitudinally fixed in place using nuts, or other fixing means.

Additionally, the switch may include a contact spring 261 and a return spring 262. The contact spring 261 may be disposed between the wings 213, 214 and the contact plate 250 while the return spring 262 may be disposed between the lock ring 251 and the terminal housing 100 (e.g., refer to FIGS. 1F-1G). As such, during operation, the return spring 262 may be biased to apply pressure on the lock ring 251, and thus, the shaft 210. First and second engagement ramps 230 and 240 are disposed in the cavity 202 of the contact housing 200. The engagement ramps 230, 240 are positioned to contact the wings 213, 214 when the shaft 210 is rotated.

Figure 1E:
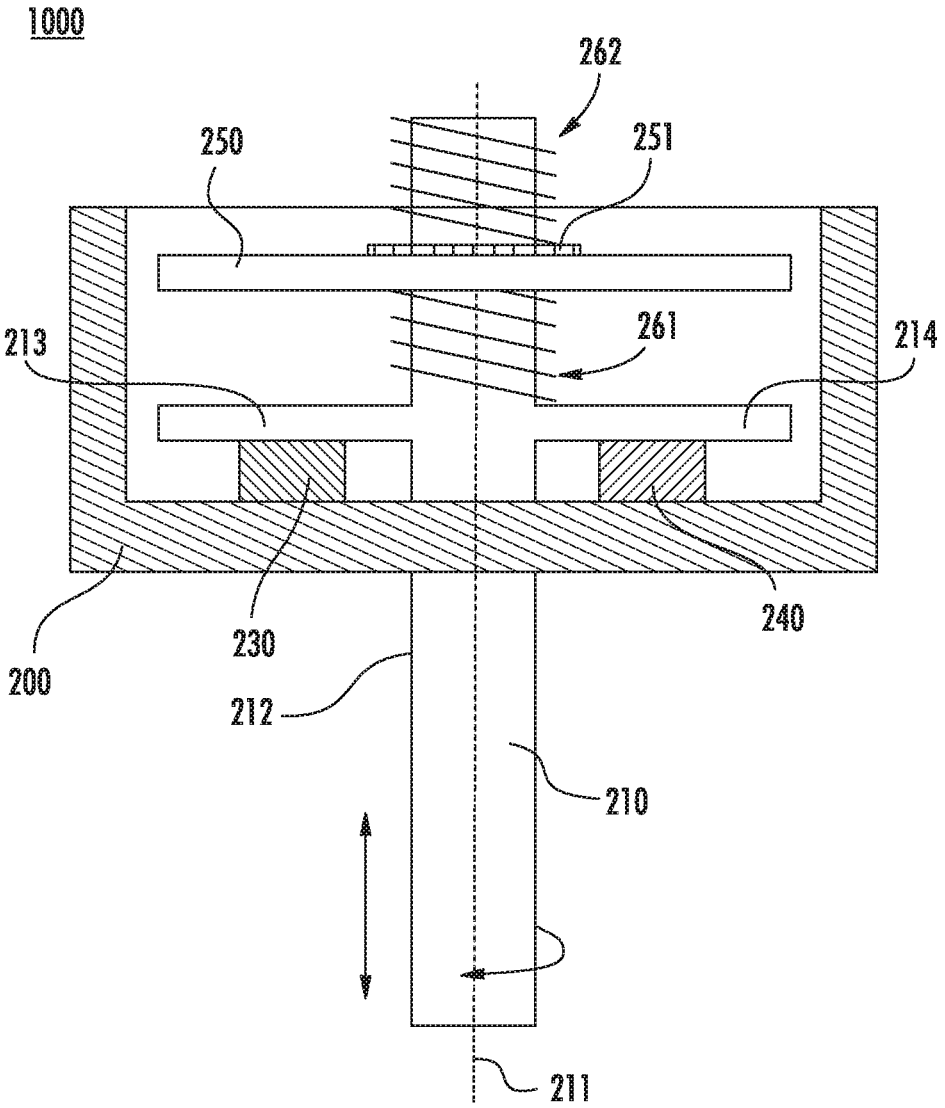

Turning now to FIG. 1E, the cut-away view of the contact housing 200 from FIG. 1D is shown. In FIG. 1E, however, the shaft 210 is shown having been moved along the length of the central axis 211. Said differently, the shaft 210 has moved longitudinally along the central axis 211 from the position shown in FIG. 1D. The shaft 210 may be moved longitudinally along the central axis 211 by rotating the shaft 210 about the central axis 211 such that the wings 213, 214 contact the engagement ramps 230, 240 and slide up the engagement ramps 230, 240, thereby moving the shaft 210. As depicted, the wings 213, 214 have moved away from the inner surface of the contact housing 200 and are positioned near the top of the engagement ramps 230, 240.

Figure 1F:
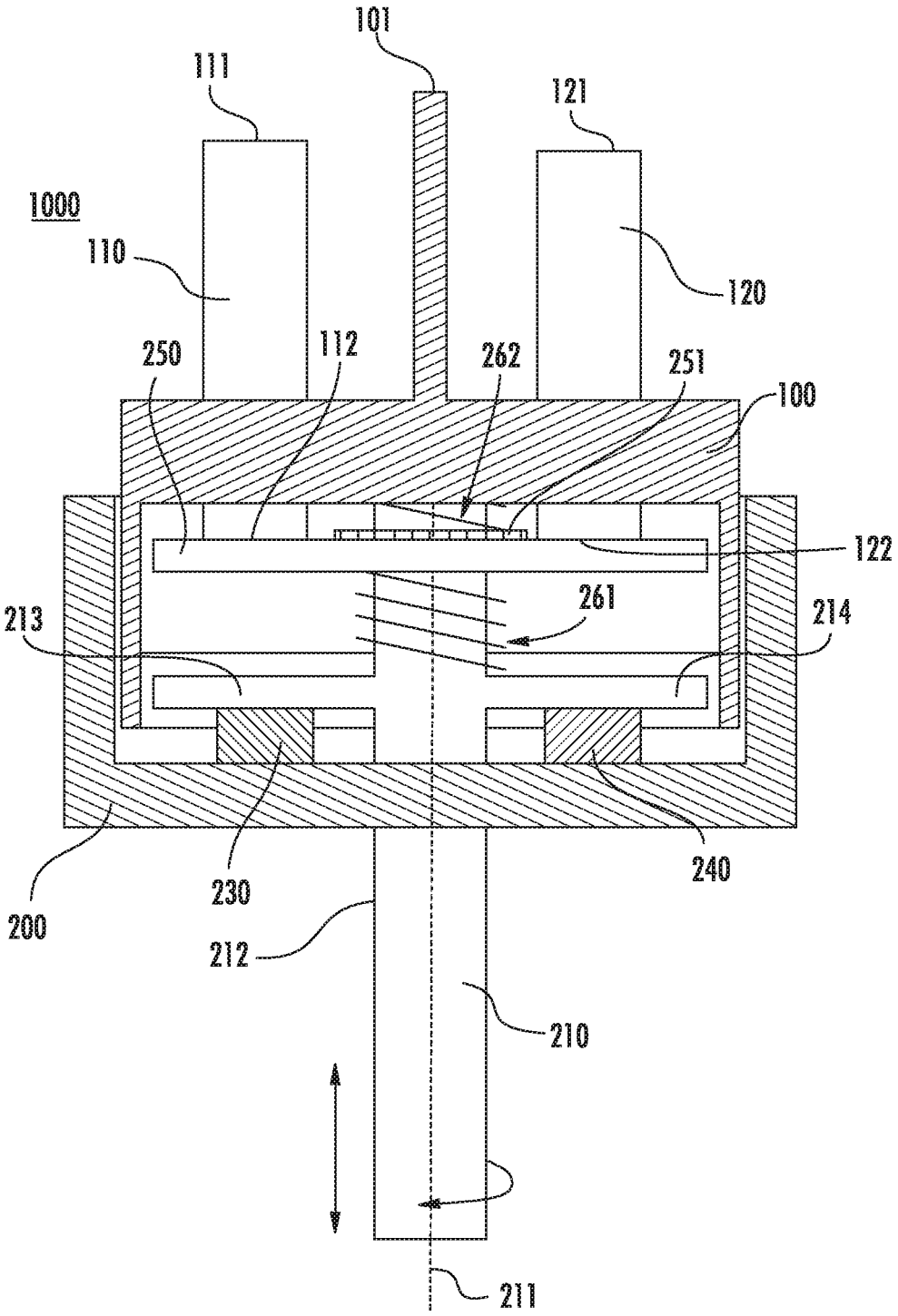

Referring now more particularly to FIG. 1F, the switch 1000 is shown with the terminal housing 100 and the contact housing 200 mated together. As can be seen, the contact housing 200 fits inside the cavity 104 of the terminal housing 100. Although the terminal housing 100 is depicted as fitting inside the cavity 202 of the contact housing 200, this is not intended to be limiting. For example, in some embodiments, the contact housing 200 may fit inside the cavity 104 of the terminal housing 100. With some embodiments, the terminal housing 100 and the contact housing 200 may be mated together by other means (e.g., epoxy, bolts, interlocking portions, or the like).

FIG. 1F shows the switch 1000 in the ON position. More specifically, the terminals 111, 121 are shown electrically connected by the contact plate 250. That is, the contact portions 112, 122 of the studs 110, 120 are shown in physical and electrical contact with the contact plate 250, thereby electrically connecting the terminal portions 111, 121. As such, if power source (e.g., battery, generator, or the like) were connected to one of the terminal portions and a load connected to the other terminal portion, current may flow from the power source to the load.

The switch 1000 may be turned to the ON position by rotating the shaft 210 about the central axis 211 (e.g., rotating the shaft 210 clockwise, or the like). As the shaft 210 is rotated, the wings 213, 214 contact the engagement ramps 230, 240 and slide up the engagement ramps, thus moving the contact plate 250 towards the contact portions 112, 122 of the studs 110, 120. It is important to note, that the disengagement ramps 130, 140 are not shown in FIG. 1F for clarity. Additionally, the return spring 262 may be compressed between the lock ring 251 and the terminal housing 100. More particularly, the return spring 262 may be compressed between the terminal housing 100 and the lock ring 251, which is fixed to the shaft 210. As the shaft 210 continues to rotate, it moves farther up the engagement ramps 230, 240 and the contact plate 250 physically contacts the contact portions 112, 122 of the studs 110, 120. Once the contact plate 250 physically contacts the studs 110, 120, the contact spring 261 compresses. When the shaft 210 is rotated so that the wings 213, 214 have moved to the top of the engagement ramps 230, 240, the wings may fall into a recess (refer to FIGS. 2A-2E) located at the top of the ramp. The contact spring 261, may be biased to exert pressure on the contact plate 250 and the wings 213, 214 to assist in keeping the switch 1000 in the ON position. For example, the contact spring 261 may be in a generally compressed state between the wings 213, 214 and the contact plate 250 when the wings 213, 214 are in the recesses.

It is important to note, that although not shown in these figures, when the switch 1000 is turned to the ON position and the contact plate 250 physically contacts the contact portions 112, 122 or the studs 110, 120, the shaft 210 may continued to rotate (e.g., to the top of the engagement ramps, or the like). As a result, the shaft 210 may continue to move longitudinally along the central axis 211, thus creating a gap (not shown) between the lock ring 251 and the contact plate 250. Additionally, the contact spring 261 may be further compressed between the contact plate 250 and the wings 213, 214, which may further assist in retaining the wings in the recesses 231, 232.

The switch 1000 may be turned to the OFF position by rotating the shaft 210 about the central axis 211 (e.g., rotating the shaft 210 counter-clockwise, or the like). During operation when the contact plate 250 is not "stuck" to the contact portions 112, 122 of the studs 110, 120 the wings 213, 214 will move out of the recesses at the top of the engagement ramps 230, 240 (refer to FIGS. 2A-2E) and slide down the engagement ramps. The return spring 262 may assist in moving the contact plate 250 away from the contact portions 112, 122 of the studs 110, 120 by exerting pressure on the shaft 210. More specifically, as the return spring 262 is in contact with the lock ring 251 and the lock ring 251 is fixed to the shaft 210. As such, the force of the return spring 262 will be exerted on the shaft 210. For example, as the return spring 262 is in a generally compressed state when the switch is in the ON position, when the shaft is rotated to turn the switch to the OFF position, the return spring 262 will exert force on the shaft 210 (e.g., through the lock ring 251) and assist in moving the shaft 210 longitudinally such that the switch is turned OFF. Said differently, the return spring 262 will push the contact plate 250 away from the contact portions 112, 122 of the studs 110, 120 to electrically disconnect the terminals 111, 121 from each other. When the wings 213, 214 reach the bottom of the engagement ramps 230, 240 the shaft 210 will stop turning. Additionally, the shaft will have rotated a distance axially and/or moved a distance laterally to indicate that the switch is in the OFF position.

Figure 1G:
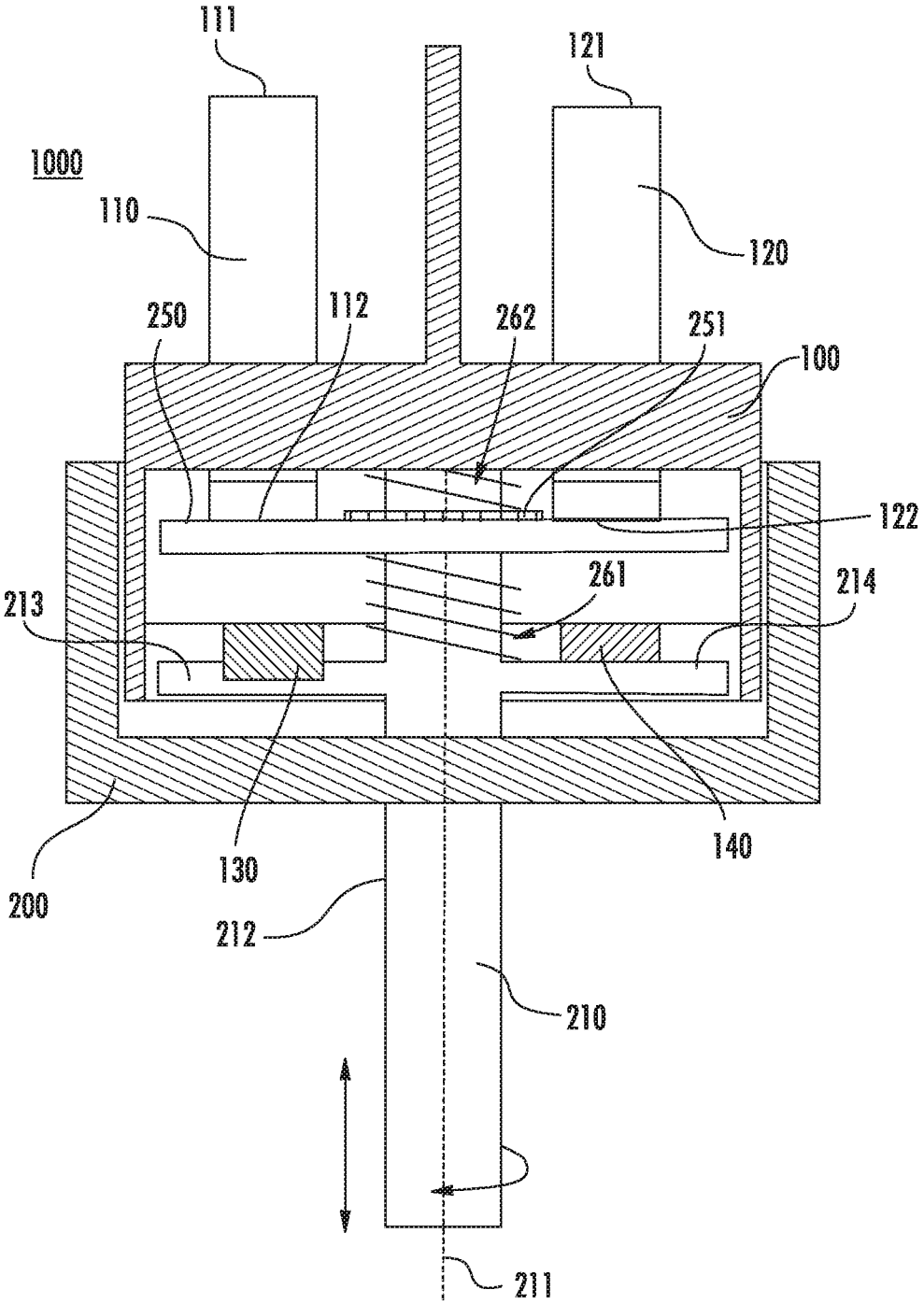

Turning more particularly to FIG. 1G, the switch may be turned off even where the contact plate 250 is "stuck" to the contact portions 112, 122 of the studs 110, 120. During operation when the contact plate 250 is "stuck" (e.g., by contact weld, or the like) the contact plate 250 may not move away from the studs due to the force of the return spring 262 alone. That is, the force on the shaft 210 from the return spring 262 may not be enough to break the contact weld between the contact plate 250 and the contact portions 112, 122 of the studs 110, 120. In such cases, as the shaft 210 rotates, the wings 213, 214 will not slide down the engagement ramps 230, 240 (not shown for clarity) but instead will rotate around to contact the disengagement ramps 130, 140. As the wings 213, 214 contact the disengagement ramps 130, 140 they will slide down the disengagement ramps 130, 140 and force the contact plate 250 away from the studs 110, 120. As the contact plate 250 is longitudinally fixed in place on the shaft 210, the motion of the shaft 210 away from the studs 110, 120 combined with the force of the return spring 262 may be enough to break a contact weld between the contact plate 250 and the contact portions 112, 122 of the studs 110, 120. Once the contact weld is broken, the shaft 210 may continue to rotate and the return spring 262 will exert force on the shaft 210 as described above to assist in moving the shaft 210 longitudinally such that the switch 1000 is turned off. Said differently, the return spring 262 will push the lock ring 251 and thus the shaft 210 and the contact plate 250 away from the contact portions 112, 122 of the studs 110, 120 to electrically disconnect the terminals 111, 121 from each other. When the wings 213, 214 reach the bottom of the engagement ramps 230, 240 the shaft 210 will stop turning. Additionally, the shaft will have rotated a distance and/or moved a distance to indicate that the switch is in the OFF position.

In such a scenario where the contact weld is not broken, the shaft 210 will not rotate about the central axis 211 past the disengagement ramps. As such, feedback may be provided to an operator that the switch is not in the OFF position. Said differently, the lack of axial rotation and/or longitudinal movement of the shaft 210 may indicate that the switch is not OFF.

Figure 2A:
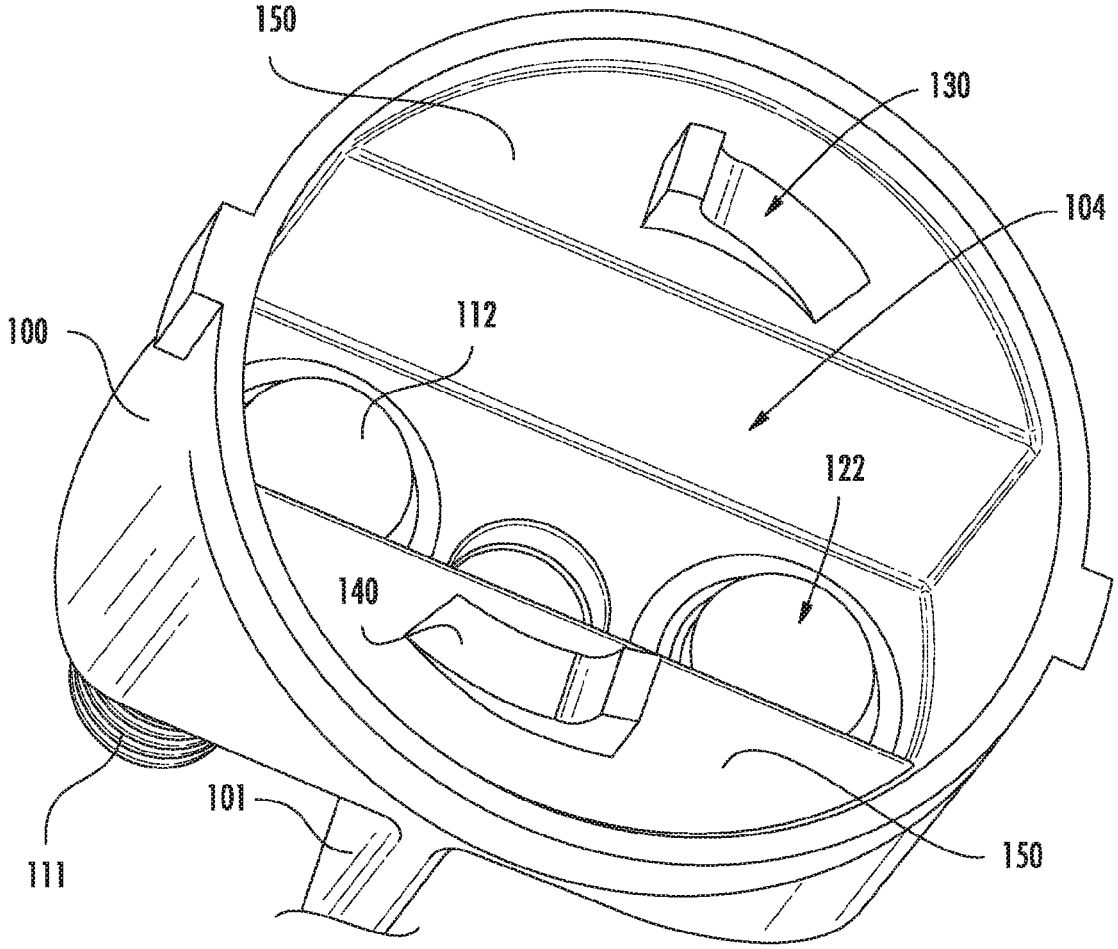
FIGS. 2A-2E are isometric diagrams illustrating a switch.
Figure 2B:
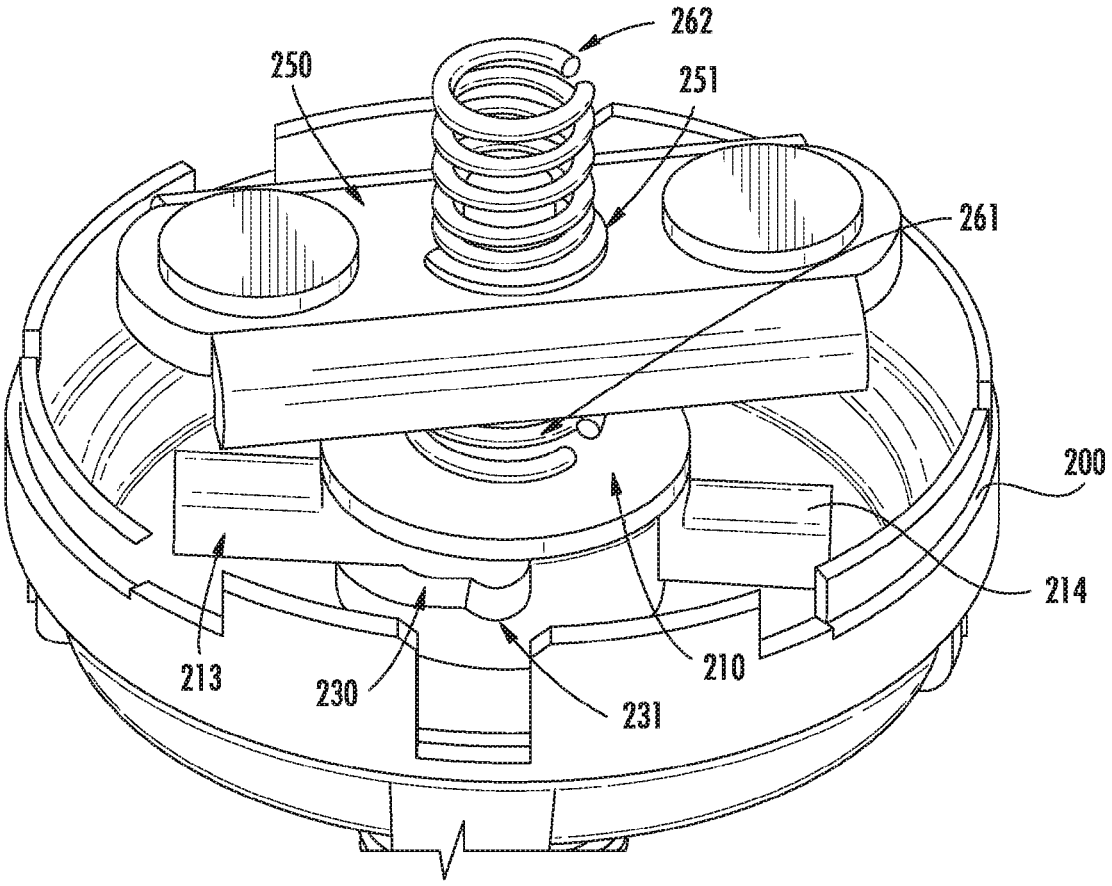
Figure 2C:
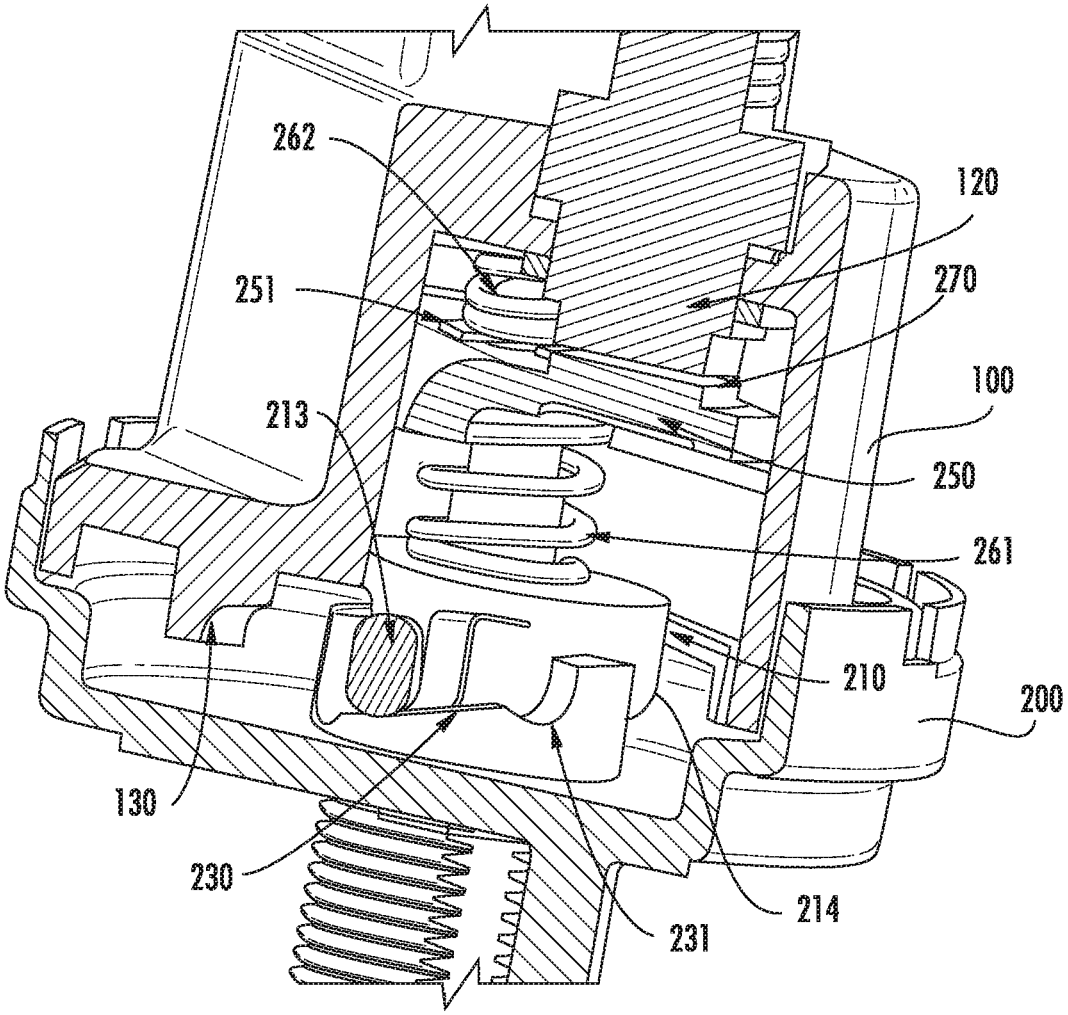
Figure 2D:
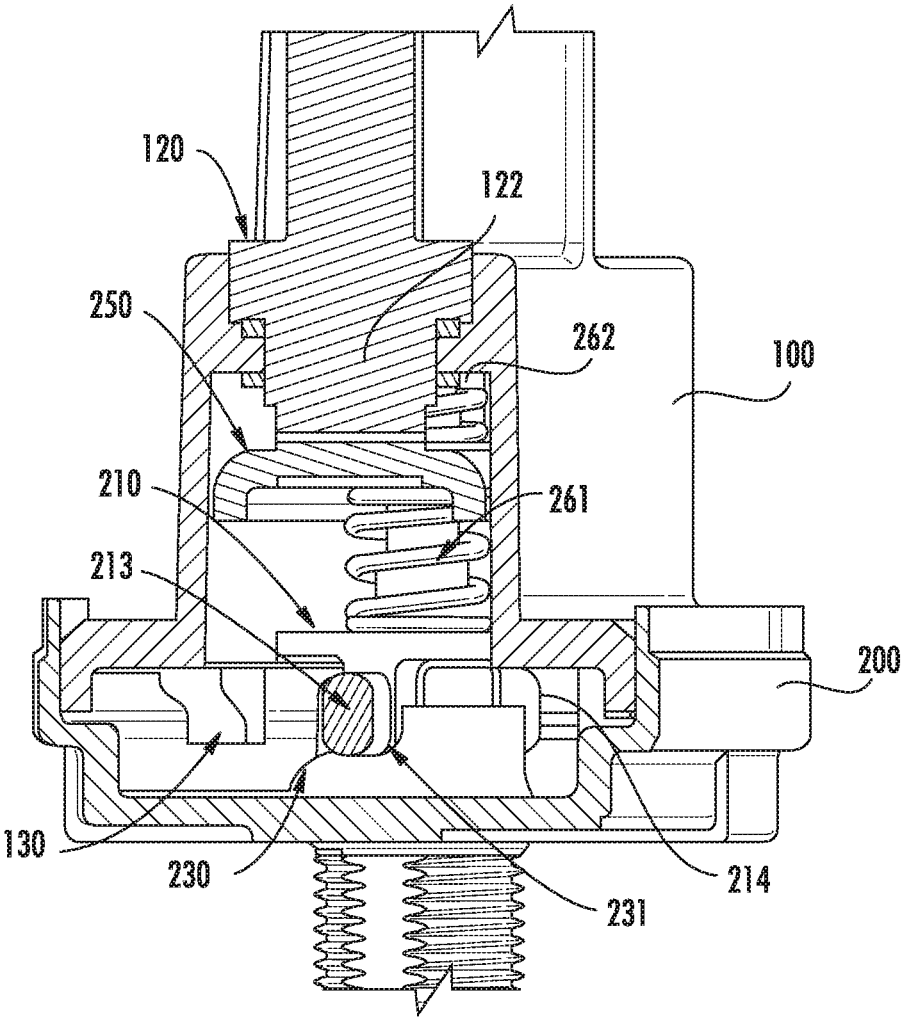
Figure 2F:
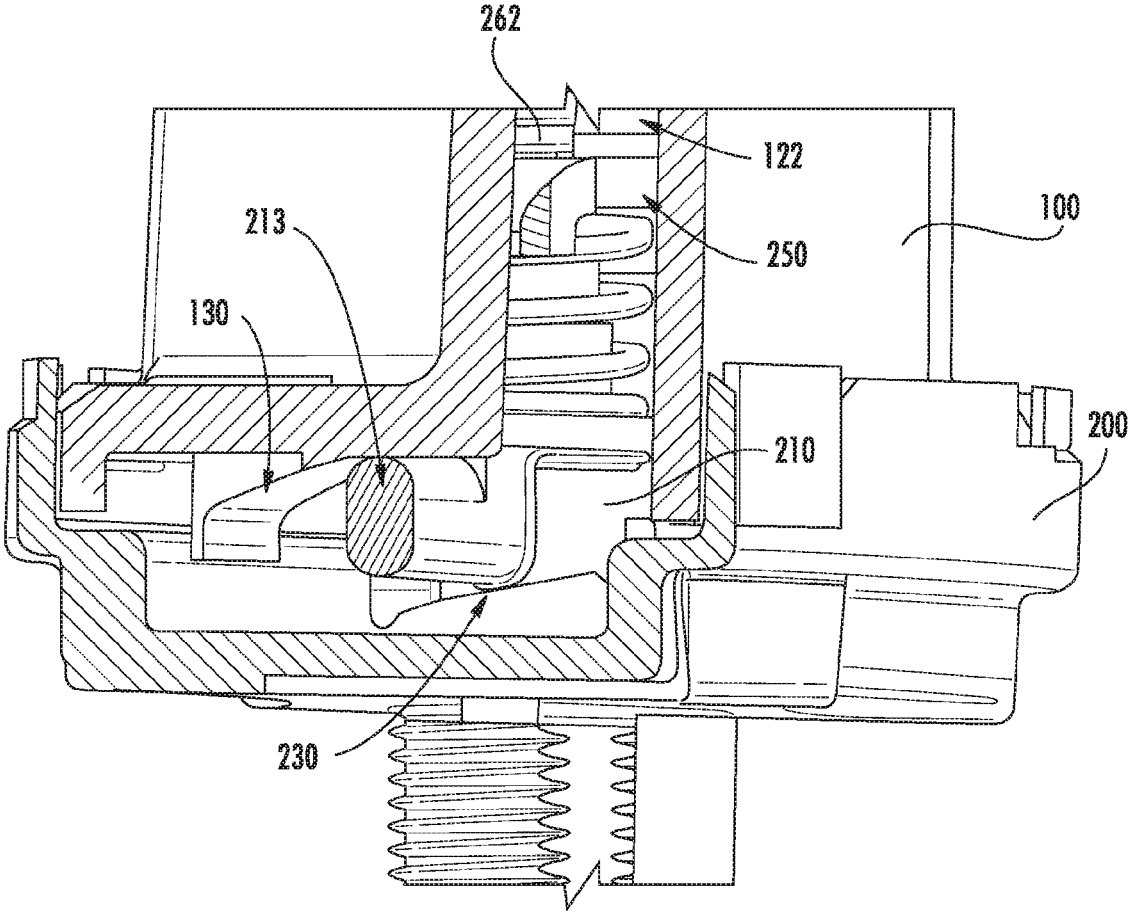

FIGS. 2A-2E illustrate isometric views of the master disconnect switch 1000. In general, FIGS. 2A-2B show isometric views of the various component parts of the switch 1000 while FIGS. 2C-2E show isometric views of the switch 1000 during operation. Turning more particularly to FIG. 2A, an isometric view of the terminal housing 100 including the cavity 104 is depicted. The first and second studs 110, 120 are shown disposed in the first and second through-holes 102, 103 (not shown). The contact portions 112, 122 and the terminal portion 111 are also shown. It is to be appreciated, that the terminal portion 121 is obscured by the angle of viewing. However, the partition 101, which separates the terminal portion 111 from the terminal portion 121 is shown. The first and second disengagement ramps 130, 140 are also shown. As can be seen, the disengagement ramps 130, 140 are positioned on a shelf 150 so that the disengagement ramps will contact the wings during operation (see FIGS. 2C-2E).

Referring now more particularly to FIG. 2B, an isometric view of the contact housing 200 is shown. The shaft 210, disposed in the third through-hole 201 is shown. Additionally, the wings 213, 214, which extend out orthogonally from the shaft 210 are shown. The contact plate 250 is disposed on the shaft 210. The contact plate is fixed in place by the lock ring 251 as described above. Additionally, the contact spring 261 and the return spring 262 are shown. Engagement ramp 230, including recess 231 is also shown. It is to be appreciated, that the engagement ramp 240 and corresponding recess 241 are obscured by the viewing angle.

Turning more specifically to FIG. 2C, the switch 1000 is shown. In this figure, the shaft 210 is shown being rotated from the OFF position to the ON position. The switch 1000 may be turned to the ON position by rotating the shaft 210 about the central axis. As the shaft 210 is rotated, the wings 213, 214 contact the engagement ramps 230, 240 and slide up the engagement ramps, moving the contact plate 250 towards the contact portions 112, 122 of the studs 110, 120. However, a gap 270 is shown indicating that the contact plate has not yet physically and electrically connected the studs 110, 120 together. Additionally, the return spring 262 is shown being compressed between the contact plate 250 and the terminal housing 100. As the shaft 210 continues to rotate, it will move farther up the engagement ramps 230, 240 and the contact plate 250 will physically contact the contact portions 112, 122 of the studs 110, 120.

This is shown in FIG. 2D. Once the contact plate 250 physically contacts the studs 110, 120, the contact spring 261 compresses. When the shaft 210 is rotated so that the wings 213, 214 have moved to the top of the engagement ramps 230, 240, the wings may fall into the recesses 231, 241 and the contact spring 261 may assist in keeping the switch in the ON position. Said differently, the contact spring 261 may exert force on the wings 213, 214 to keep them lodged in the recesses 231, 241, which may assist in keeping the switch in the ON position.

Turning more particularly to FIG. 2E, the switch may be turned off even where the contact plate 250 is stuck (e.g., contact welded, or the like) to the contact portions 112, 122 of the studs 110, 120. As the shaft 210 rotates, the wings 213, 214 will contact the disengagement ramps 130, 140. As the wings 213, 214 contact the disengagement ramps 130, 140 they will slide down the disengagement ramps 130, 140 and force the contact plate 250 away from the studs 110, 120. As the contact plate 250 is longitudinally fixed in place on the shaft 210, the motion of the shaft 210 away from the studs 110, 120 combined with the force of the return spring 262 may be enough to break a contact weld between the contact plate 250 and the studs 110, 120. Once the contact weld is broken, the shaft 210 may continue to rotate and the return spring 262 will exert force on the shaft 210 as described above to assist in moving the shaft 210 longitudinally such that the switch 1000 is turned OFF. In such a scenario where the contact weld is not broken, the shaft 210 will not rotate about the central axis 211, which may provide feedback to an operator that the switch is not in the OFF position.

Figure 3:
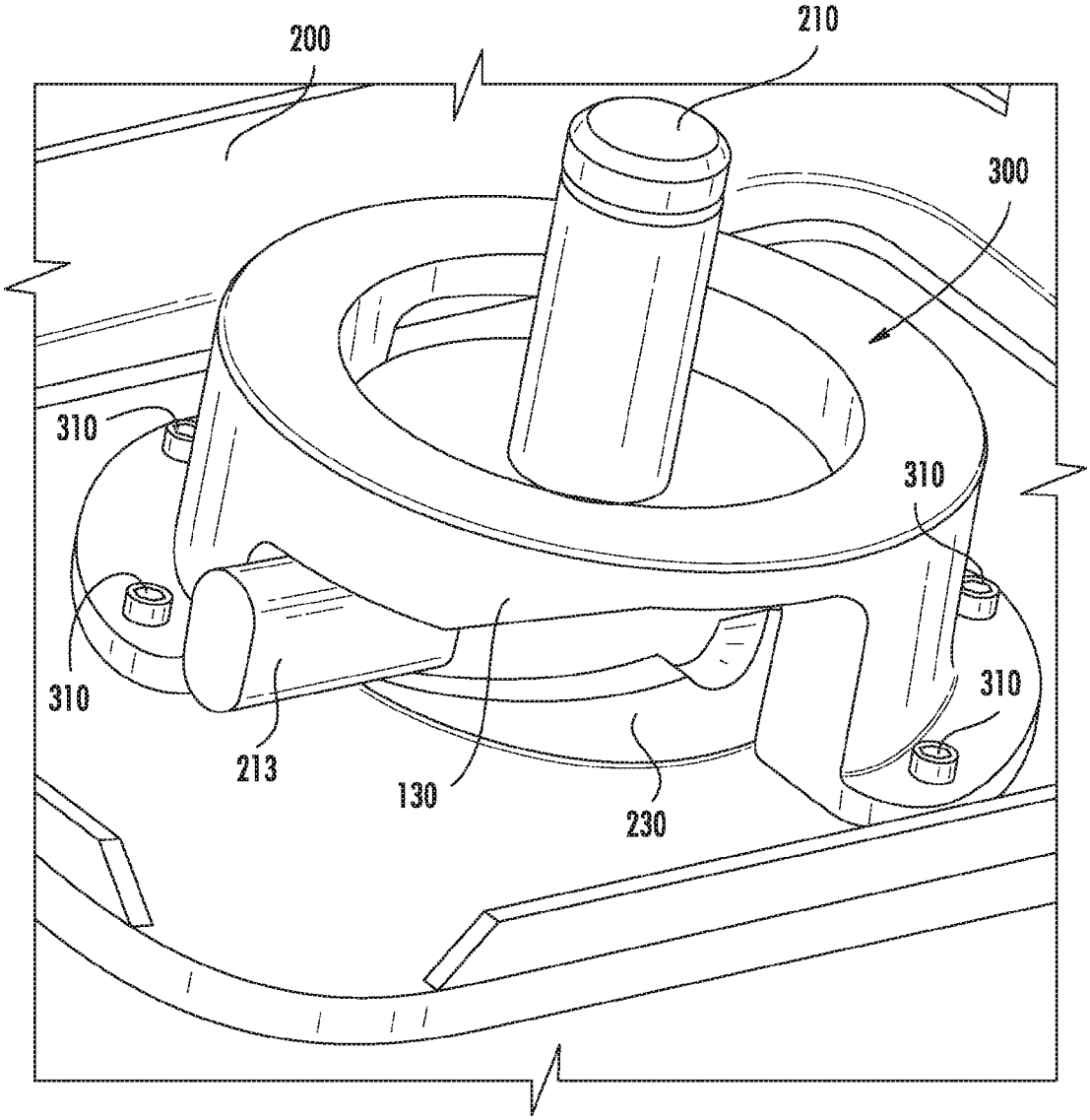
FIG. 3 is an isometric diagram of a portion of a switch, all arranged according to at least some embodiments of the present disclosure.

FIG. 3 illustrates an isometric view of an embodiment of the contact housing 200 described above. In general, FIG. 3 shows an embodiment where the disengagement ramps are separate from the terminal housing. For example, as can be seen from this Figure, the contact housing 200, including the engagement ramps 230, 240 is shown. Additionally, the shaft 210 with wings 213, 214 is also shown. Note, that the engagement ramp 240 and the wing 214 are obscured by the viewing angle. A disengagement ramp platform 300 is also shown. As depicted, the disengagement ramp platform 300 is fixed to the contact housing 200 through bolts 310. With some examples, the disengagement ramp platform 300 may be fixed to the contact housing 200 by other means (e.g., screws, rivets, epoxy, or the like). The disengagement ramp platform includes the disengagement ramps 130, 140 described above. It is noted, that the disengagement ramp 140 is obscured by the viewing angle. Accordingly, an embodiment of the switch 1000 described above may be provided where the disengagement ramps 130, 140 are separate from the terminal housing 100. For example, the disengagement ramps 130, 140 may be provided with the disengagement ramp platform 300, which may be affixed to the contact housing 200 as shown in FIG. 3. Operation of such a switch may be similar to that described above.

While the present disclosure has been described with reference to certain embodiments, numerous modifications, alterations and changes to the described embodiments are possible without departing from the spirit and scope of the claims. Accordingly, it is intended that the following claims not be limited to the described embodiments, but that it has the full scope defined by the recited claim language, and any equivalents thereof.

What is claimed is:

1. A switch comprising:

first and second terminals to connect a source of power to a load;

a shaft rotatable about a central axis and moveable longitudinally along the central axis, the shaft having a wing extending out orthogonally from the central axis;

a contact plate to physically and electrically connect the first and second terminals when the shaft is moved longitudinally along the central axis;

a disengagement ramp to contact the wing when the shaft is rotated about the central axis, the disengagement ramp to force the shaft to move longitudinally along the central axis as the shaft is rotated to move the contact plate away from the first and second terminals;

a contact housing, the shaft disposed in the contact housing;

a terminal housing, the first and second terminals disposed in the terminal housing, the terminal housing and the contact housing mateable together to enclose the contact plate and the disengagement ramp;

an engagement ramp to contact the wing when the shaft is rotated about the central axis, the engagement ramp to force the shaft to move longitudinally along the central axis as the shaft is rotated to move the contact plate towards the first and second terminals;

wherein the wing is a first wing, the disengagement ramp is a first disengagement ramp, and the engagement ramp is a first engagement ramp, the switch further comprising:

a second wing extending out from the shaft orthogonal to the central axis;

a second engagement ramp to contact the second wing when the shaft is rotated about the central axis, the engagement ramp to force the shaft to move longitudinally along the central axis as the shaft is rotated to move the contact plate towards the first and second terminals; and a second disengagement ramp to contact the second wing when the shaft is rotated about the central axis, the disengagement ramp to force the shaft to move longitudinally along the central axis as the shaft is rotated to move the contact plate away from the first and second terminals.

2. The switch recited in claim 1, the first and second engagement ramps including a recessed portion, the switch further comprising a contact spring biased to place pressure on the first and second wings when the first and second wings are rotated to the recessed portions.

3. The switch recited in claim 1, further comprising a return spring, the return spring biased to apply pressure to move the contact plate away from the first and second terminals.

4. A switch comprising:

a first stud for connecting to a source of power;

a second stud for connecting to a load;

a shaft rotatable about a central axis and moveable along the length of the central axis, the shaft having a first wing and a second wing, the first and second wing extending out orthogonally from the central axis;

a contact plate disposed on the shaft, the contact plate to electrically connect the first and second studs when the shaft is moved longitudinally along the central axis to electrically connect a source of power to a load; and a first disengagement ramp and a second disengagement ramp to contact the first and second wings when the shaft is rotated about the central axis to force the shaft to move longitudinally and move the contact plate away from the first and second studs to electrically disconnect the first and second studs;

a terminal housing having a cavity and a first through-hole and a second through-hole disposed therein, the first stud disposed in the first through-hole such that at least a portion of the first stud is extending into the cavity of the terminal housing, the second stud disposed in the second through-hole such that at least a portion of the second stud is extending into the cavity of the switch housing; and a contact housing having a cavity and a third through-hole disposed therein, the shaft disposed in the third through-hole.

5. The switch recited in claim 4, wherein the terminal housing and the contact housing are mateable together.

6. The switch recited in claim 5, wherein the contact housing is disposed over the terminal housing such that the terminal housing is disposed in the cavity of the contact housing.

7. The switch recited in claim 4, further comprising a first engagement ramp and a second engagement ramp to contact the first and second wings when the shaft is rotated about the central axis to force the shaft to move longitudinally along the central axis to move the contact plate towards the portions of the first and second studs extending into the cavity in the terminal housing to electrically connect the first and second stud.

8. The switch recited in claim 7, wherein the first and second engagement ramps are disposed in the cavity of the contact housing.

9. The switch recited in claim 8, the first and second engagement ramps including a recessed portion, the switch further comprising a contact spring biased to place pressure on the first and second wings when the shaft is rotated such that the first and second wings are disposed in the recessed portions.

10. The switch recited in claim 4, wherein the first and second disengagement ramps are disposed in the cavity of the terminal housing.

11. The switch recited in claim 4, further comprising a return spring, the return spring biased to apply pressure to move the contact plate away from the first and second studs.

* * * * *